US010814618B2

(12) United States Patent
Saito et al.

(10) Patent No.: US 10,814,618 B2
(45) Date of Patent: Oct. 27, 2020

(54) LIQUID EJECTING APPARATUS

(71) Applicant: SEIKO EPSON CORPORATION, Tokyo (JP)

(72) Inventors: Noriaki Saito, Nagano (JP); Osamu Shinkawa, Nagano (JP); Masashi Kamiyanagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/574,133

(22) Filed: Sep. 18, 2019

(65) Prior Publication Data

US 2020/0094547 A1 Mar. 26, 2020

(30) Foreign Application Priority Data

Sep. 20, 2018 (JP) ..... 2018-176248

(51) Int. Cl.
*B41J 2/045* (2006.01)
*B41J 2/055* (2006.01)

(52) U.S. Cl.
CPC ..... *B41J 2/04541* (2013.01); *B41J 2/04581* (2013.01); *B41J 2/04588* (2013.01); *B41J 2/055* (2013.01)

(58) Field of Classification Search
CPC ..... B41J 2/04541; B41J 2/04581; B41J 2/04588; B41J 2/055
See application file for complete search history.

(56) References Cited

U.S. PATENT DOCUMENTS

2005/0212846 A1* 9/2005 Shinkawa ..... B41J 2/0451 347/19
2010/0328382 A1* 12/2010 Kobayashi ..... B41J 2/04596 347/11
2015/0062219 A1 3/2015 Otokita
2019/0009527 A1* 1/2019 Yamada ..... B41J 2/04581

FOREIGN PATENT DOCUMENTS

JP 2017-105219 A 6/2017

* cited by examiner

*Primary Examiner* — Lamson D Nguyen
(74) *Attorney, Agent, or Firm* — Global IP Counselors, LLP

(57) ABSTRACT

A liquid ejecting apparatus includes a generation unit that generates a driving signal, a discharge portion including a piezoelectric element that is driven by the driving signal, and a detection unit that detects residual vibration occurring in the discharge portion, in a detection period after a driving period during which the piezoelectric element is driven by the driving signal, in which the generation unit maintains a potential of the driving signal at a first potential in a first period, maintains the potential of the driving signal at a second potential in a second period, maintains the potential of the driving signal at a third potential in a third period, and maintains the potential of the driving signal at a detection potential in the detection period, the first potential is a potential between the second potential and the third potential, and the detection potential is a potential between the first potential and the second potential.

5 Claims, 13 Drawing Sheets

FIG. 8

| Sd[m] | DESIGNATION CONTENT OF Sd[m] | Ga[m] | | Gb[m] | | | Gs[m] | | |
|---|---|---|---|---|---|---|---|---|---|
| | | Tu1 | Tu2 | TSS1 | TSS2 | TSS3 | TSS1 | TSS2 | TSS3 |
| 1 | LARGE DOT | H | H | L | L | L | L | L | L |
| 2 | MEDIUM DOT | H | L | L | L | L | L | L | L |
| 3 | SMALL DOT | L | H | L | L | L | L | L | L |
| 4 | NON-DISCHARGE | L | L | L | L | L | L | L | L |
| 5 | DISCHARGE DETERMINATION | L | L | H | L | H | L | H | L |

LIQUID EJECTING APPARATUS

The present application is based on, and claims priority from JP Application Serial Number 2018-176248, filed Sep. 20, 2018, the disclosure of which is hereby incorporated by reference herein in its entirety.

BACKGROUND

1. Technical Field

The present disclosure relates to a liquid ejecting apparatus.

2. Related Art

In a liquid ejecting apparatus such as an ink jet printer, liquid such as ink filled in a pressure chamber provided in a discharge portion is discharged from a nozzle by driving a piezoelectric element provided in the discharge portion included in the liquid ejecting apparatus, and an image is formed on a recording medium. In such a liquid ejecting apparatus, when foreign matter such as paper dust adheres to the nozzle, a trajectory of the liquid discharged from the nozzle deviates from a desired trajectory, and thus image quality of the image formed on the recording medium is degraded. Therefore, in order to prevent the degradation of the image quality of the image formed on the liquid ejecting apparatus, it is necessary to identify whether or not there is the foreign matter adhering to the nozzle. For example, a technology of determining whether or not the foreign matter adheres to the nozzle provided in the discharge portion based on a result of detection of a residual vibration generated in the discharge portion, after the piezoelectric element is driven to push out the liquid from the discharge portion, is disclosed in JP-A-2017-105219.

However, in the related art, a residual vibration generated in a discharge portion when foreign matter adheres to a nozzle and a residual vibration generated in the discharge portion when the foreign matter does not adhere to the nozzle may have substantially the same waveform. In some cases, whether or not the foreign matter adheres to the nozzle may not be accurately determined.

SUMMARY

According to an aspect of the present disclosure, there is provided a liquid ejecting apparatus including a generation unit that generates a driving signal, a discharge portion including a piezoelectric element that is driven by the driving signal and a pressure chamber that discharges a liquid from a nozzle according to the driving of the piezoelectric element, and a detection unit that detects residual vibration occurring in the discharge portion, in a detection period after a driving period during which the piezoelectric element is driven by the driving signal, in which the generation unit maintains a potential of the driving signal at a first potential in a first period of the driving period, maintains the potential of the driving signal at a second potential in a second period after the first period of the driving period, maintains the potential of the driving signal at a third potential in a third period after the second period of the driving period, and maintains the potential of the driving signal at a detection potential in the detection period, the first potential is a potential between the second potential and the third potential, and the detection potential is a potential between the first potential and the second potential.

BRIEF DESCRIPTION OF THE DRAWINGS

FIG. 8 is a diagram for illustrating an example of an individual designation signal.

DESCRIPTION OF EXEMPLARY EMBODIMENTS

Hereinafter, an aspect for carrying out the present disclosure will be described with reference to the accompanying drawings. However, in each drawing, the dimension and the scale of each component are appropriately different from the actual ones. Further, since the embodiment described below is a preferable specific example of the present disclosure, various technically preferable limitations are added. However, the scope of the present disclosure is not limited to the embodiment as long as there is no statement for particularly limiting the present disclosure in the following description.

A. First Embodiment

In the present embodiment, a liquid ejecting apparatus will be described by exemplifying an ink jet printer that forms an image on a recording paper sheet P by ejecting ink. In the present embodiment, the ink is an example of "liquid", and the recording paper sheet P is an example of a "medium".

1. Outline of Ink Jet Printer

Hereinafter, a configuration of an ink jet printer 1 according to the present embodiment will be described with reference to FIGS. 1 and 2.

Figure 1:
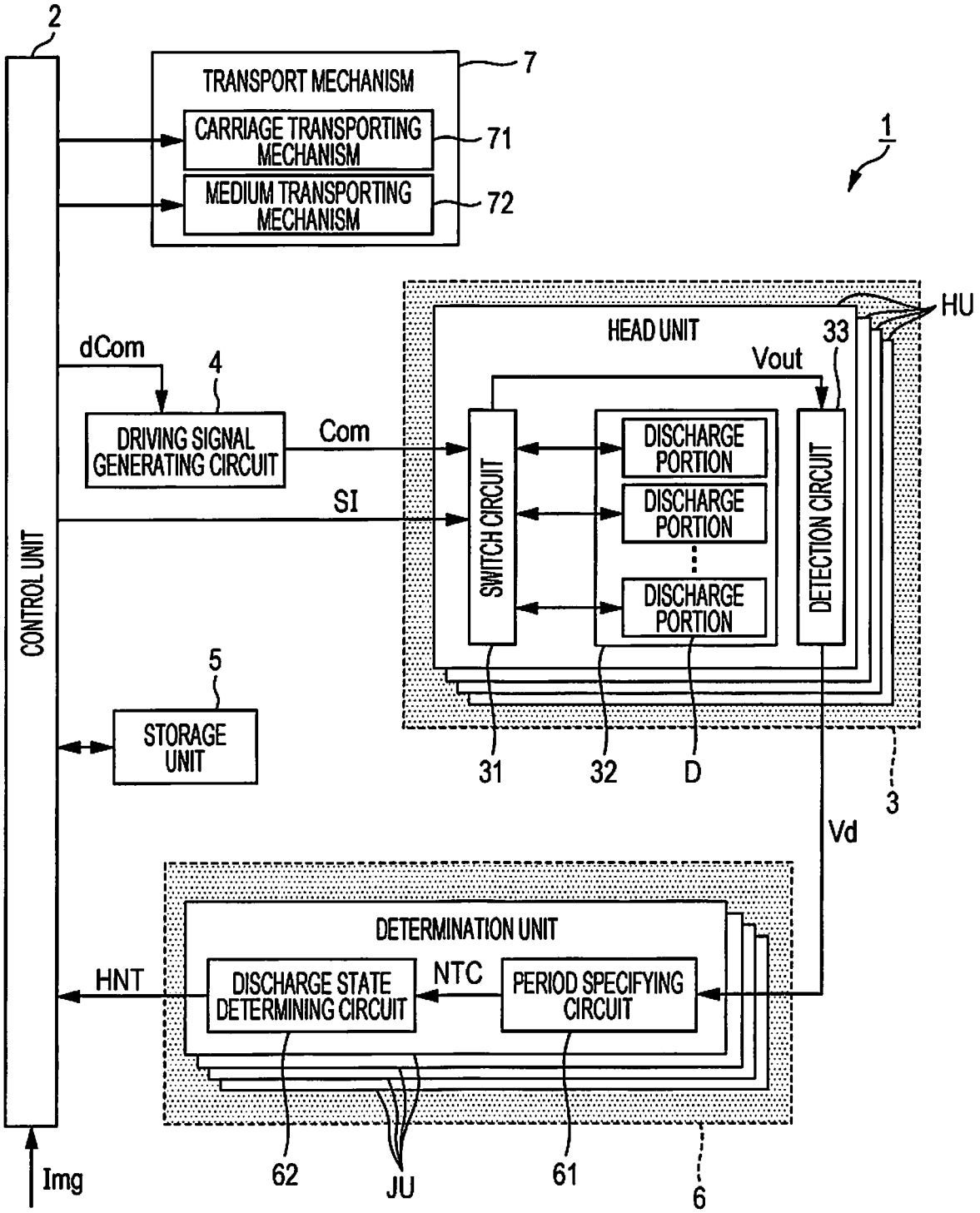
FIG. 1 is a block diagram showing an example of a configuration of an ink jet printer according to a first embodiment of the present disclosure.

FIG. 1 is a block diagram showing functions of an example of a configuration of the ink jet printer 1. Printing data Img indicating an image to be formed by the ink jet printer 1 is supplied to the ink jet printer 1 from a host computer such as a personal computer or a digital camera. The ink jet printer 1 performs printing processing of forming, on the recording paper sheet P, an image represented by the printing data Img supplied from the host computer.

As shown in FIG. 1, the ink jet printer 1 includes a control unit 2 that controls each component of the ink jet printer 1, a head module 3 provided with a head unit HU in which a discharge portion D that ejects ink is provided, a driving signal generating circuit 4 that generates a driving signal Com for driving the discharge portion D, a storage unit 5 that stores various pieces of information, a determination module 6 provided with a determination unit JU that determines a discharge state of the ink in the discharge portion D, and a transport mechanism 7 for changing a relative position of and the recording paper sheet P to the head module 3. The driving signal generating circuit 4 is an example of a "generation unit".

In the present embodiment, as shown in FIG. 1, a case where the head module 3 includes four head units HU and the determination module 6 includes four determination units JU corresponding to the four head units HU, respectively, is described as an example. Hereinafter, one head unit HU of the four head units HU and one determination unit JU of the four determination units JU, corresponding to the one head unit HU, will be described. However, this description is applied to the other head units HU and the other determination units JU in the same manner.

The control unit 2 includes a CPU. However, the control unit 2 may include a programmable logic device such as an FPGA instead of the CPU or in addition to the CPU. Here, the CPU is an abbreviation of a central processing unit, and the FPGA is an abbreviation of a field-programmable gate array. The control unit 2 causes the CPU to operate according to a control program stored in the storage unit 5 so as to generate a signal for controlling an operation of each component of the ink jet printer 1, such as a printing signal SI and a waveform designation signal dCom.

Here, the waveform designation signal dCom is a digital signal that defines a waveform of the driving signal Com. Further, the driving signal Com is an analog signal that drives the discharge portion D. The driving signal generating circuit 4 includes a DA converting circuit, and generates the driving signal Com having a waveform defined by the waveform designation signal dCom. In the present embodiment, it is assumed that the driving signal Com includes a driving signal Com-A and a driving signal Com-B. Further, the printing signal SI is a digital signal for designating the type of an operation of the discharge portion D. In detail, the printing signal SI is a signal that designates the type of the operation of the discharge portion D by designating whether or not the driving signal Com is supplied to the discharge portion D.

As shown in FIG. 1, the head unit HU includes a switch circuit 31, a recording head 32, and a detection circuit 33. The recording head 32 includes M discharge portions D. Here, the value M is a natural number satisfying "M≥1". Hereinafter, an m-th discharge portion D among the M discharge portions D provided in the recording head 32 may be referred to as a discharge portion D[m]. Here, the variable m is a natural number satisfying "1≤m≤M". Further, in the following description, when a component or a signal of the ink jet printer 1 corresponds to the discharge portion DM among the M discharge portions D, the suffix [m] may be added to a reference numeral to represent the component, the signal, or the like. The switch circuit 31 switches supply of the driving signal Com to the discharge portion DM based on the printing signal SI. Hereinafter, the driving signal Com supplied to the discharge portion D[m] among the driving signal Com may be referred to as a supply driving signal Vin[m]. Further, the switch circuit 31 switches supply, to the detection circuit 33, of a detection potential signal Vout[m] indicating a potential of an upper electrode Zu[m] of a piezoelectric element PZ[m] provided in the discharge portion D[m] based on the printing signal SI. The piezoelectric element PZ[m] and the upper electrode Zu[m] will be described below with reference to FIG. 3. The detection circuit 33 generates a residual vibration signal Vd[m] based on the detection potential signal Vout[m]. The residual vibration signal Vd[m] represents a waveform of residual vibration that is vibration remaining in the discharge portion D[m] after the discharge portion D[m] is driven by the supply driving signal Vin[m]. The detection circuit 33 is an example of a "detection unit".

Further, as described above, as shown in FIG. 1, the ink jet printer 1 according to the present embodiment includes the determination unit JU that determines the discharge state of the ink in the discharge portion DM based on the residual vibration signal Vd[m]. The determination unit JU includes a period specifying circuit 61 and a discharge state determining circuit 62. The determination unit JU is an example of a "determination section". The period specifying circuit 61 generates period information NTC indicating a period of the residual vibration signal Vd[m], based on the residual vibration signal Vd[m]. The discharge state determining circuit 62 determines the discharge state of the ink in the discharge portion DM based on the period information NTC, and generates determination information HNT indicating a result of the determination. Hereinafter, a process related to the generation of the determination information HNT by the determination unit JU may be referred to as discharge state determining processing. Further, hereinafter, for the discharge state determining processing, the discharge portion D[m], which is a target of detection of the detection potential signal Vout[m] by the detection circuit 33, may be referred to as a determination target discharge portion D-S.

Figure 2:
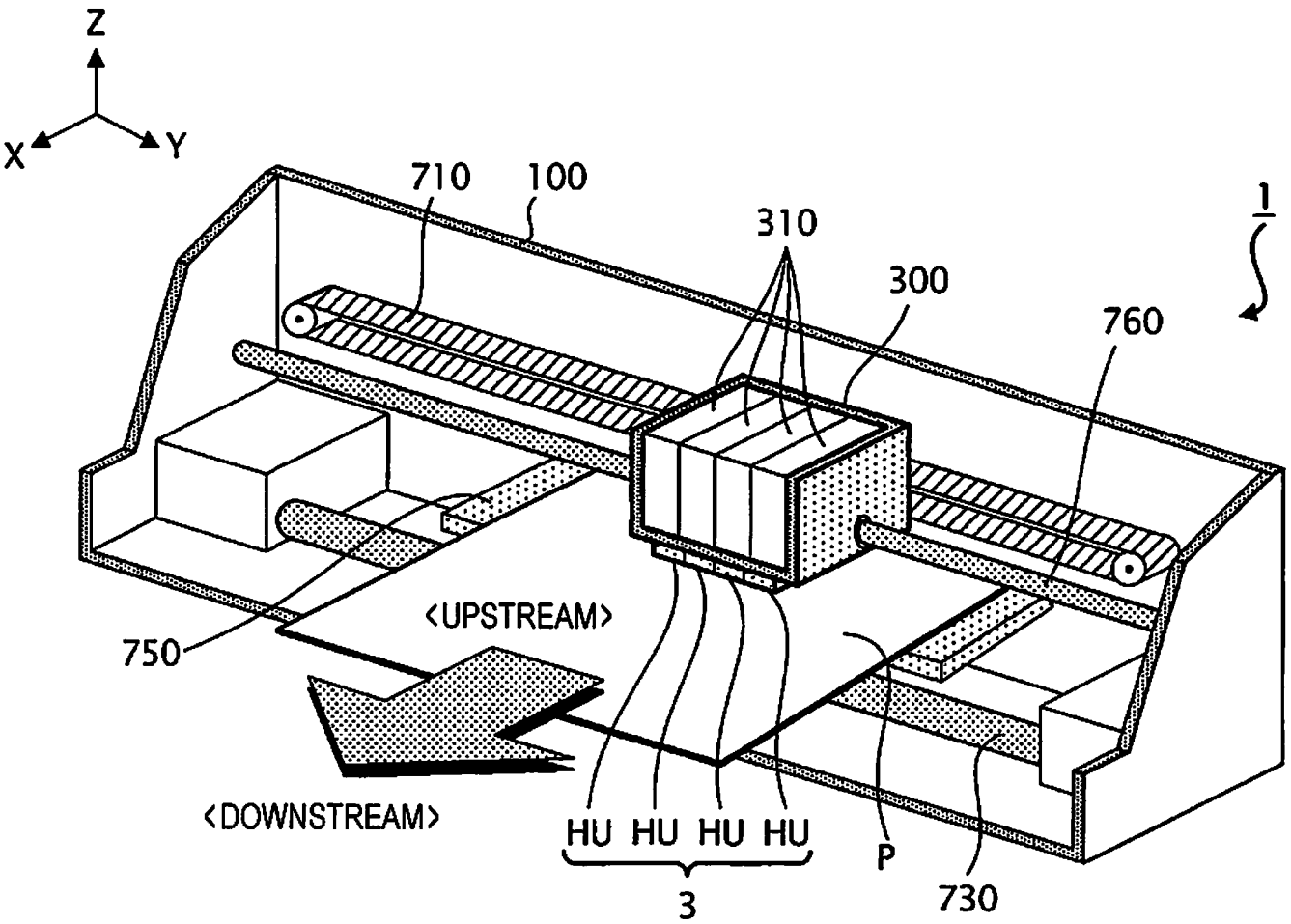
FIG. 2 is a perspective view showing an example of a schematic internal structure of the ink jet printer.

FIG. 2 is a perspective view showing an example of a schematic internal structure of the ink jet printer 1. As shown in FIG. 2, in the present embodiment, it is assumed that the ink jet printer 1 is a serial printer. In detail, when performing the printing processing, in the ink jet printer 1, while the recording paper sheet P is transported in a sub scanning direction and the head module 3 reciprocates in a main scanning direction intersecting the sub scanning direction, the ink is discharged from the discharge portion D, so that dots corresponding to the printing data Img are formed on the recording paper sheet P.

Hereinafter, a +X direction and a −X direction that is opposite to the +X direction are collectively referred to as an "X axis direction", a +Y direction intersecting the X axis direction and a −Y direction that is opposite to the +Y direction are collectively referred to as an "Y axis direction", and a +Z direction intersecting the X axis direction and the Y axis direction and a −Z direction that is opposite to the +Z direction are collectively referred to as a "Z axis direction". Then, in the present embodiment, as shown in FIG. 2, a direction from a −X side that is upstream to a +X side that is downstream is defined as the sub scanning direction, and the +Y direction and the −Y direction are defined as the main scanning direction.

As shown in FIG. 2, the ink jet printer 1 according to the present embodiment includes a housing 100 and a carriage 300 on which the head module 3 that can reciprocate inside the housing 100 in the Y axis direction is mounted. Further, as described above, the ink jet printer 1 according to the present embodiment includes a transport mechanism 7. When the printing processing is performed, the transport mechanism 7 changes the relative position of the recording paper sheet P to the head module 3 by causing the carriage 300 to reciprocate in the Y axis direction and transporting the recording paper sheet P in the +X direction, and thus can land the ink on the entire recording paper sheet P. As shown in FIG. 1, the transport mechanism 7 includes a carriage transporting mechanism 71 for causing the carriage 300 to reciprocate and a medium transporting mechanism 72 for transporting the recording paper sheet P. Further, as shown in FIG. 2, the transport mechanism 7 includes a carriage guide shaft 760 that supports the carriage 300 in the Y axis direction to reciprocate and a timing belt 710 fixed to the carriage 300 and driven by the carriage transporting mechanism 71. Therefore, the transport mechanism 7 can cause the head module 3 together with the carriage 300 to reciprocate along the carriage guide shaft 760 in the Y axis direction. Further, the transport mechanism 7 includes a platen 750 that is provided on a −Z side of the carriage 300 and a transport roller 730 that is rotated according to driving of the medium transporting mechanism 72 to transport the recording paper sheet P on the platen 750 in the −X direction.

In the present embodiment, as shown in FIG. 2, it is assumed that the carriage 300 includes four ink cartridges 310 corresponding to four colored inks of cyan, magenta, yellow, and black, respectively. Further, in the present embodiment, as an example, it is assumed that the four ink cartridges 310 are provided to correspond to the four head units HU, respectively. Each discharge portion D receives the ink from the ink cartridge 310 corresponding to the head unit HU to which the corresponding discharge portion D belongs. Accordingly, each discharge portion D can be filled with the supplied ink and can discharge the filled ink from a nozzle N. The ink cartridge 310 may be provided outside the carriage 300.

Here, an outline of an operation of the control unit 2 when the printing processing is performed will be described. When the printing processing is performed, the control unit 2 first causes the storage unit 5 to store the printing data Img supplied from the host computer. Next, the control unit 2 generates a signal for controlling the head unit HU such as the printing signal SI, a signal for controlling the driving signal generating circuit 4 such as the waveform designation signal dCom, and a signal for controlling the transport mechanism 7, based on various pieces of data stored in the storage unit 5, such as the printing data Img. Then, the control unit 2 controls the driving signal generating circuit 4 and the switch circuit 31 to drive the discharge portion D while controlling the transport mechanism 7 to change the relative position of the recording paper sheet P to the head module 3, based on various signals such as the printing signal SI and various pieces of data stored in the storage unit 5. Accordingly, the control unit 2 adjusts presence and absence of the ink from the discharge portion D, a discharge amount of the ink, a discharge timing of the ink, and the like, and controls each component of the ink jet printer 1 to perform the printing processing of forming an image corresponding to the printing data Img on the recording paper sheet P.

Further, as described above, the ink jet printer 1 according to the present embodiment performs the discharge state determining processing. The discharge state determining processing is a series of processes performed by the ink jet printer 1, including processing in which the control unit 2 selects the determination target discharge portion D-S that is a target of the discharge state determining processing, processing in which the driving signal generating circuit 4 generates the driving signal Com based on the waveform designation signal dCom output from the control unit 2, processing in which the switch circuit 31 drives the determination target discharge portion D-S by supplying the driving signal Com output from the driving signal generating circuit 4 as the supply driving signal Vin to the determination target discharge portion D-S under a control of the control unit 2, processing in which the detection circuit 33 generates a residual vibration signal Vd according to the detection potential signal Vout indicating the residual vibration generated in the determination target discharge portion D-S, processing in which the period specifying circuit 61 generates the period information NTC based on the residual vibration signal Vd, and processing in which the discharge state determining circuit 62 determines the discharge state of the ink in the determination target discharge portion D-S based on the period information NTC and generates the determination information HNT indicating a result of the corresponding determination. Here, the determination of the discharge state of the ink in the determination target discharge portion D-S, performed by the discharge state determining circuit 62, is a process of determining whether or not the discharge state of the ink from the determination target discharge portion D-S is normal, that is, whether or not discharge abnormality occurs in the determination target discharge portion D-S. Further, a state in which the discharge state of the ink in the discharge portion D is abnormal, that is, a state in which the ink cannot be accurately discharged from the nozzle N provided in the discharge portion D, is collectively referred to as the discharge abnormality. In more detail, the discharge abnormality is a state in which even though the discharge portion D is driven by the driving signal Com to discharge the ink from the discharge portion D, the ink cannot be discharged in a mode defined by the driving signal Com. Here, a discharge mode of the ink, defined by the driving signal Com, is a mode in which the discharge portion D discharges an amount of the ink defined by the waveform of the driving signal Com at a speed defined by the waveform of the driving signal Com. That is, a state in which the ink cannot be discharged according to the discharge mode of the ink defined by the driving signal Com includes a state in which an amount of the ink, which is different from the discharge amount of the ink defined by the driving signal Com, is discharged from the discharge portion D and a state in which the ink cannot be landed on a desired landing position of the recording paper sheet P since the ink is discharged at a speed that is different from a discharge speed of the ink defined by the driving signal Com, in addition to a state in which the ink cannot be discharged from the discharge portion D.

2. Outline of Recording Head and Discharge Portion

The recording head 32 and the discharge portion D provided in the recording head 32 will be described with reference to FIGS. 3 and 4.

Figure 3:
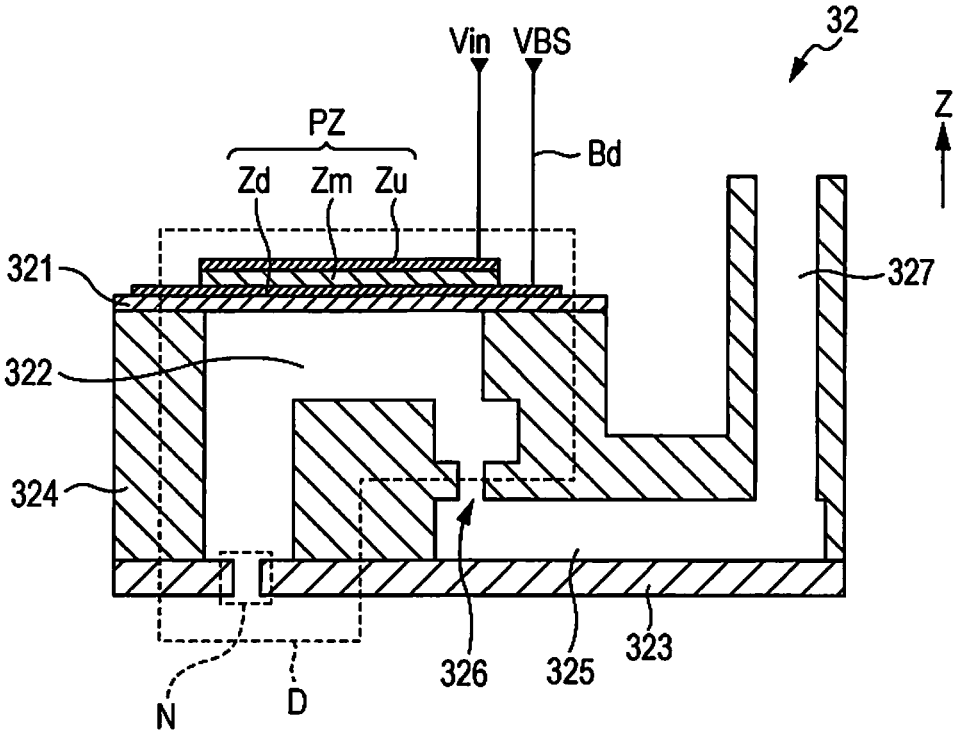
FIG. 3 is a diagram for illustrating an example of a structure of a discharge portion.

FIG. 3 is a schematic partial sectional view showing the recording head 32, obtained by cutting the recording head 32 to include the discharge portion D. As shown in FIG. 3, the discharge portion D includes the piezoelectric element PZ, a cavity 322 filled with the ink, the nozzle N communicating with the cavity 322, and a diaphragm 321. Here, the cavity 322 is an example of a "pressure chamber". The discharge portion D discharges the ink in the cavity 322 from the nozzle N by driving the piezoelectric element PZ using the supply driving signal Vin. The cavity 322 is a space defined by a cavity plate 324, a nozzle plate 323 in which the nozzle N is formed, and the diaphragm 321. The cavity 322 communicates with a reservoir 325 through an ink supply port 326. The reservoir 325 communicates with the ink cartridge 310 corresponding to the discharge portion D through an ink intake portion 327. The piezoelectric element PZ has an upper electrode Zu, a lower electrode Zd, and a piezoelectric body Zm provided between the upper electrode Zu and the lower electrode Zd. The lower electrode Zd is electrically coupled to a feeding wire Bd set to a potential VBS. Then, when the supply driving signal Vin is supplied to the upper electrode Zu, and a voltage is applied between the upper electrode Zu and the lower electrode Zd, the piezoelectric element PZ is displaced in the +Z direction or the −Z direction according to the applied voltage, and as a result, the piezoelectric element PZ vibrates. The lower electrode Zd is joined to the diaphragm 321. Therefore, when the piezoelectric element PZ is driven and vibrated by the supply driving signal Vin, the diaphragm 321 also vibrates. Then, the volume of the cavity 322 and the pressure in the cavity 322 are changed by the vibration of the diaphragm 321, and the ink filled in the cavity 322 is discharged from the nozzle N.

Figure 4:
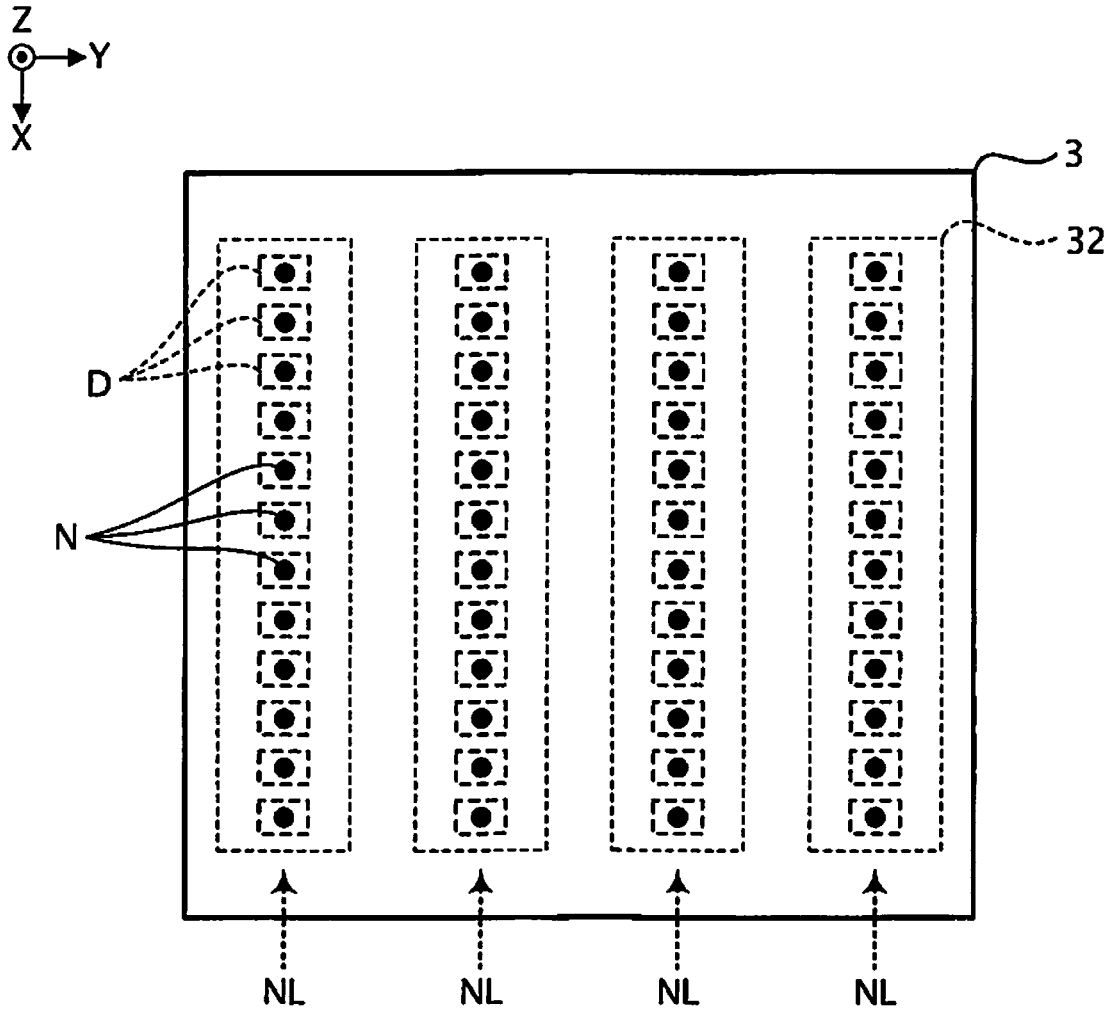
FIG. 4 is a plan view showing an example of arrangement of a nozzle of a head module.

FIG. 4 is a diagram for illustrating an example of arrangement of four recording heads 32 provided in the head module 3 and a total of 4M nozzles N provided in the four recording heads 32 when the ink jet printer 1 is viewed from the −Z direction in plan view. As shown in FIG. 4, each recording head 32 provided in the head module 3 is provided with a nozzle row NL. Here, the nozzle row NL is a plurality of nozzles N provided to extend in a row in a predetermined direction. In the present embodiment, it is assumed as an example that each nozzle row NL includes M nozzles N arranged to extend in the X axis direction.

3. Configuration of Head Unit

Hereinafter, a configuration of each head unit HU will be described with reference to FIG. 5.

Figure 5:
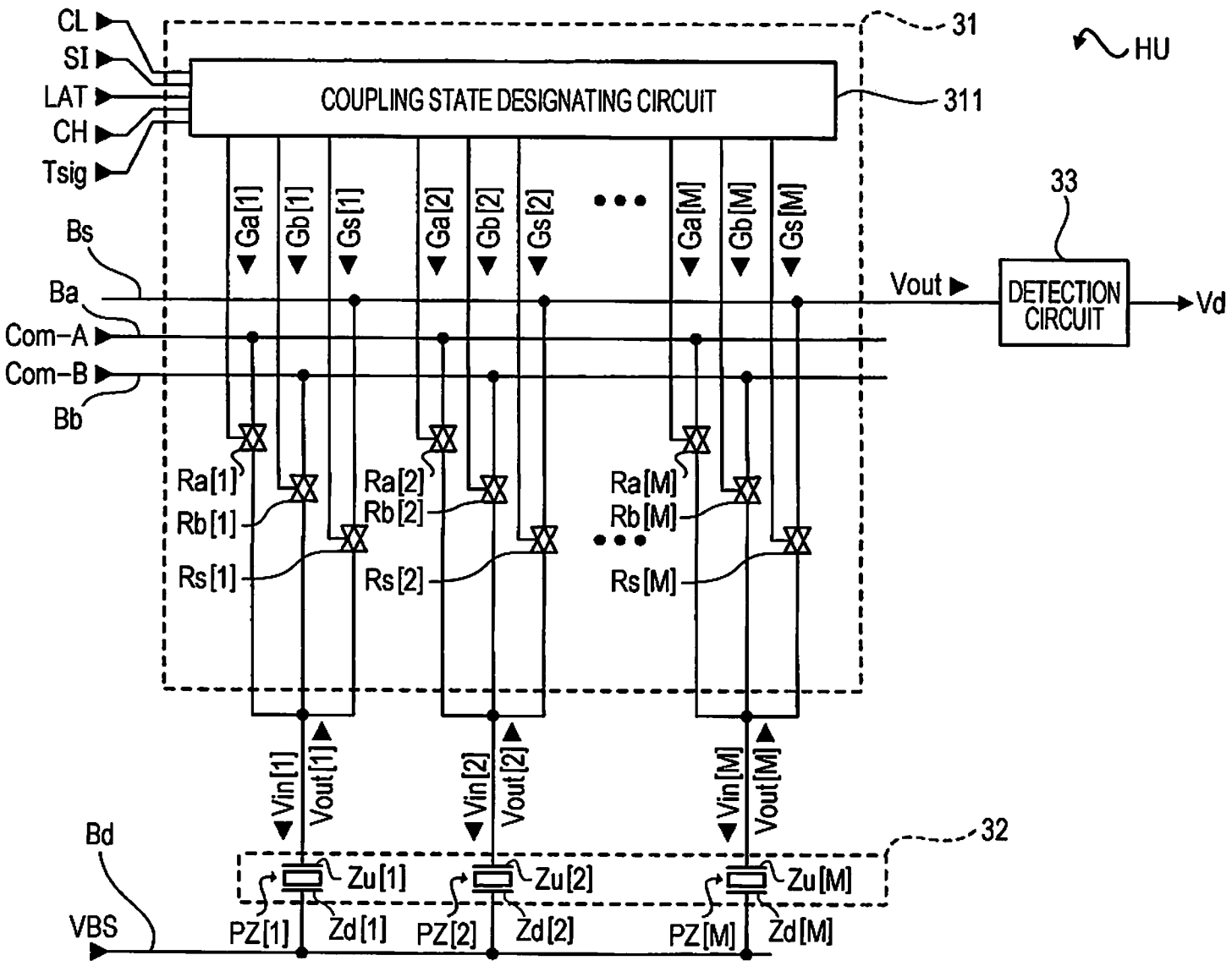
FIG. 5 is a block diagram showing an example of a configuration of a head unit.

FIG. 5 is a block diagram showing an example of the configuration of the head unit HU. As described above, the head unit HU includes the switch circuit 31, the recording head 32, and the detection circuit 33. Further, the head unit HU includes a wire Ba to which the driving signal Com-A is supplied from the driving signal generating circuit 4, a wire Bb to which the driving signal Com-B is supplied from the driving signal generating circuit 4, a wire Bs for supplying the detection potential signal Vout to the detection circuit 33, and the feeding wire Bd to which the potential VBS is supplied.

As shown in FIG. 5, the switch circuit 31 includes M switches Ra[1] to Ra[M], M switches Rb[1] to Rb[M], M switches Rs[1] to Rs[M], and a coupling state designating circuit 311 that designates a coupling state of each switch. The coupling state designating circuit 311 generates a coupling state designating signal Ga[m] that designates an ON/OFF state of the switch Ra[m], a coupling state designating signal Gb[m] that designates an ON/OFF state of the switch Rb[m], and a coupling state designating signal Gs[m] that designates an ON/OFF state of the switch Rs[m], based on at least some of the printing signal SI, a latch signal LAT, a change signal CH, and a period defining signal Tsig supplied from the control unit 2. Here, the switch Ra[m] switches conduction and non-conduction between the wire Ba and the upper electrode Zu[m] of the piezoelectric element PZ[m] provided in the discharge portion D[m], based on the coupling state designating signal Ga[m]. In the present embodiment, the switch Ra[m] is switched on when the coupling state designating signal Ga[m] is at a high level and is switched off when the coupling state designating signal Ga[m] is at a low level. Further, the switch Rb[m] switches conduction and non-conduction between the wire Bb and the upper electrode Zu[m] of the piezoelectric element PZ[m] provided in the discharge portion D[m], based on the coupling state designating signal Gb[m]. In the present embodiment, the switch Rb[m] is switched on when the coupling state designating signal Gb[m] is at a high level and is switched off when the coupling state designating signal Gb[m] is at a low level. Further, the switch Rs[m] switches conduction and non-conduction between the wire Bs and the upper electrode Zu[m] of the piezoelectric element PZ[m] provided in the discharge portion D[m], based on the coupling state designating signal Gs[m]. In the present embodiment, the switch Rs[m] is switched on when the coupling state designating signal Gs[m] is at a high level and is switched off when the coupling state designating signal Gs[m] is at a low level. As described above, the supply driving signal Vin[m] is a signal that is supplied to the piezoelectric element PZ[m] of the discharge portion D[m] through the switch Ra[m] or Rb[m] among the driving signals Com-A and Com-B.

The detection potential signal Vout[m] indicating the potential of the piezoelectric element PZ[m] of the discharge portion D[m] driven as the determination target discharge portion D-S is supplied to the detection circuit 33 through the wire Bs. The detection circuit 33 generates the residual vibration signal Vd[m] based on the detection potential signal Vout[m].

4. Operation of Head Unit

Hereinafter, an operation of each head unit HU will be described with reference to FIGS. 6 to 8.

In the present embodiment, an operation period of the ink jet printer 1 includes one or more unit periods Tu. Further, the ink jet printer 1 according to the present embodiment can drive each discharge portion D for the printing processing in each unit period Tu. Further, the ink jet printer 1 according to the present embodiment can drive the determination target discharge portion D-S in the discharge state determining processing and detect the detection potential signal Vout from the determination target discharge portion D-S, in each unit period Tu.

Figure 6:
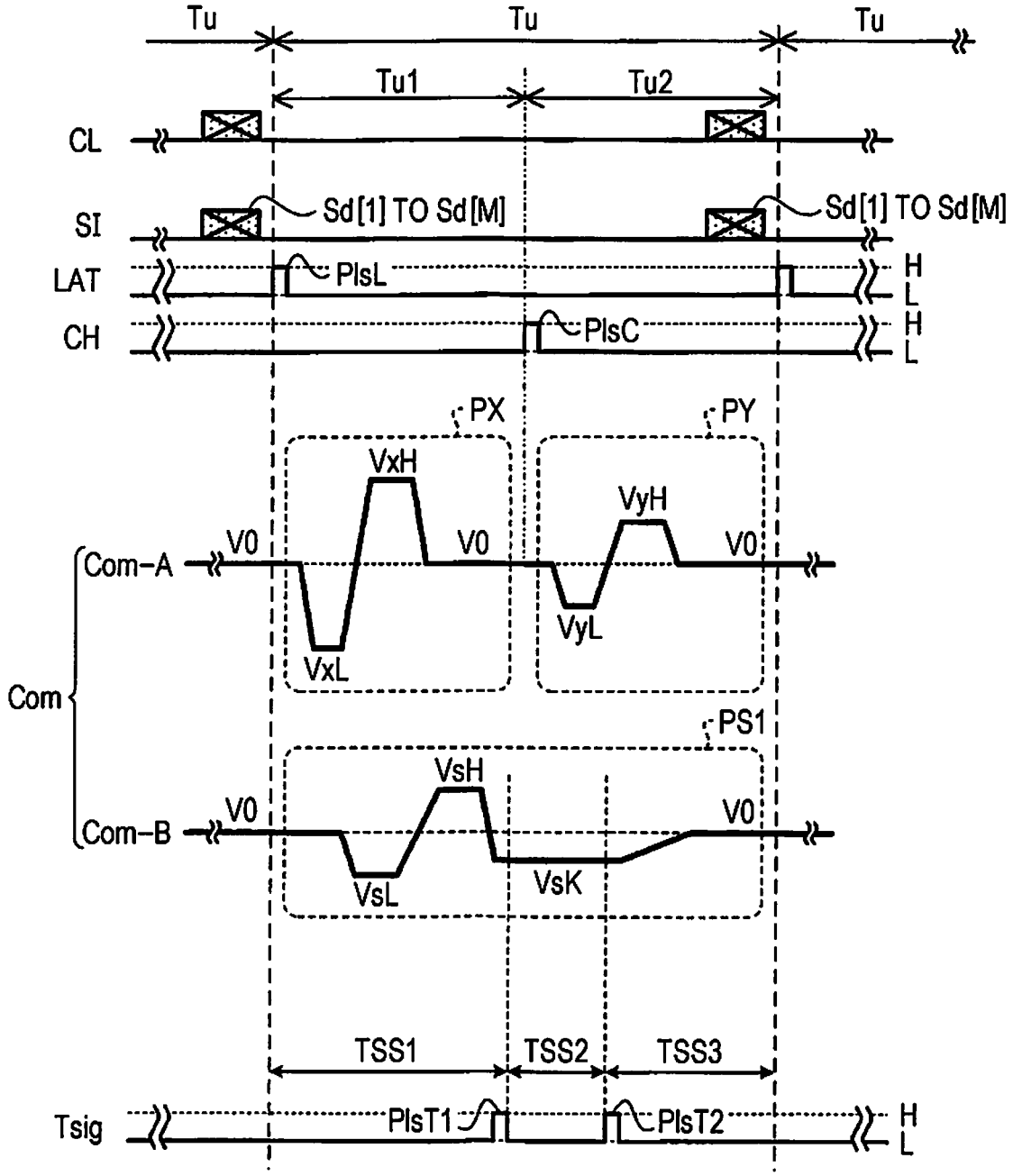
FIG. 6 is a timing chart showing an example of an operation of the ink jet printer.

FIG. 6 is a timing chart showing an operation of the ink jet printer 1 in the unit period Tu. As shown in FIG. 6, the control unit 2 outputs the latch signal LAT having a pulse PlsL. Accordingly, the control unit 2 defines the unit period Tu as a period from rising of the pulse PlsL to rising of the next pulse PlsL. Further, the control unit 2 outputs the change signal CH having a pulse PlsC in the unit period Tu. Then, the control unit 2 divides the unit period Tu into a control period Tu1 from the rising of the pulse PlsL to rising of the pulse PlsC and a control period Tu2 from the rising of the pulse PlsC to the rising of the pulse PlsL. Further, the control unit 2 outputs the period defining signal Tsig having a pulse PlsT1 and a pulse PlsT2 in the unit period Tu. Then, the control unit 2 divides the unit period Tu into a control period TSS1 from the rising of the pulse PlsL to rising of the pulse PlsT1, a control period TSS2 from the rising of the pulse PlsT1 to rising of the pulse PlsT2, and a control period TSS3 from the rising of the pulse PlsT2 to the rising of the pulse PlsL.

The printing signal SI according to the present embodiment includes individual designation signals Sd[1] to Sd[M] that designate driving modes of the discharge portions D[1] to D[M] in each unit period Tu. When the printing processing or the discharge state determining processing is performed in the unit period Tu, as shown in FIG. 6, prior to the unit period Tu, the control unit 2 synchronizes the printing signal SI including the individual designation signals Sd[1] to Sd[M] with a clock signal CL to supply the synchronized printing signal SI to the coupling state designating circuit 311. Then, the coupling state designating circuit 311 generates the coupling state designating signals Ga[m], Gb[m], and Gs[m], based on the individual designation signal Sd[m], in the unit period Tu. In the present embodiment, it is assumed that the discharge portion D[m] can form a large dot, a medium dot that is smaller than the large dot, and a small dot that is smaller than the medium dot. Then, in the present embodiment, it is assumed that the individual designation signal Sd[m] can select any one of five values of a value "1" that designates driving of a mode in which the amount of the ink, corresponding to the large dot, is discharged to the discharge portion DM, a value of '2" that designates driving of a mode in which the amount of the ink, corresponding to the middle dot, is discharged to the discharge portion DM, a value of "3" that designates driving of a mode in which the amount of the ink, corresponding to the small dot, is discharged to the discharge portion D[m], a value of "4" that designates driving of a mode in which the ink is not discharged to the discharge portion D[m], and a value of "5" that designates driving of the determination target discharge portion D-S with respect to the discharge portion D[m], in the unit period Tu.

As shown in FIG. 6, in the present embodiment, the driving signal Com-A has a waveform PX provided in the control period Tu1 and a waveform PY provided in the control period Tu2. In the present embodiment, the waveform PX and the waveform PY are defined such that a potential difference between the highest potential VxH and the lowest potential VxL of the waveform PX is larger than a potential difference between the highest potential VyH and the lowest potential VyL of the waveform PY. In detail, when the driving signal Com-A having the waveform PX is supplied to the discharge portion D[m], the waveform PX is determined such that the discharge portion D[m] is driven in the mode in which the amount of the ink, corresponding to the middle dot, is discharged. Further, when the driving signal Com-A having the waveform PY is supplied to the discharge portion D[m], the waveform PY is determined such that the discharge portion D[m] is driven in the mode in which the amount of the ink, corresponding to the small dot, is discharged. Further, in the present embodiment, the potentials of the waveform PX and the waveform PY at a start time and a termination time are set to a reference potential V0. In the present embodiment, it is assumed as an example that, when the potential of the supply driving signal Vin[m] supplied to the discharge portion D[m] is a high potential, the volume of the cavity 322 of the discharge portion D[m] is smaller, as compared to a case where the potential of the supply driving signal Vin[m] is a low potential. Therefore, when the discharge portion D[m] is driven by the supply driving signal Vin[m] having the waveform PX, the potential of the supply driving signal Vin[m] is changed from the lowest potential VxL to the highest potential VxH, and thus the ink in the discharge portion D[m] is discharged from the nozzle N. Further, when the discharge portion D[m] is driven by the supply driving signal Vin[m] having the waveform PY, the potential of the supply driving signal Vin[m] is changed from the lowest potential VyL to the highest potential VyH, and thus the ink in the discharge portion D[m] is discharged from the nozzle N.

Figure 7:
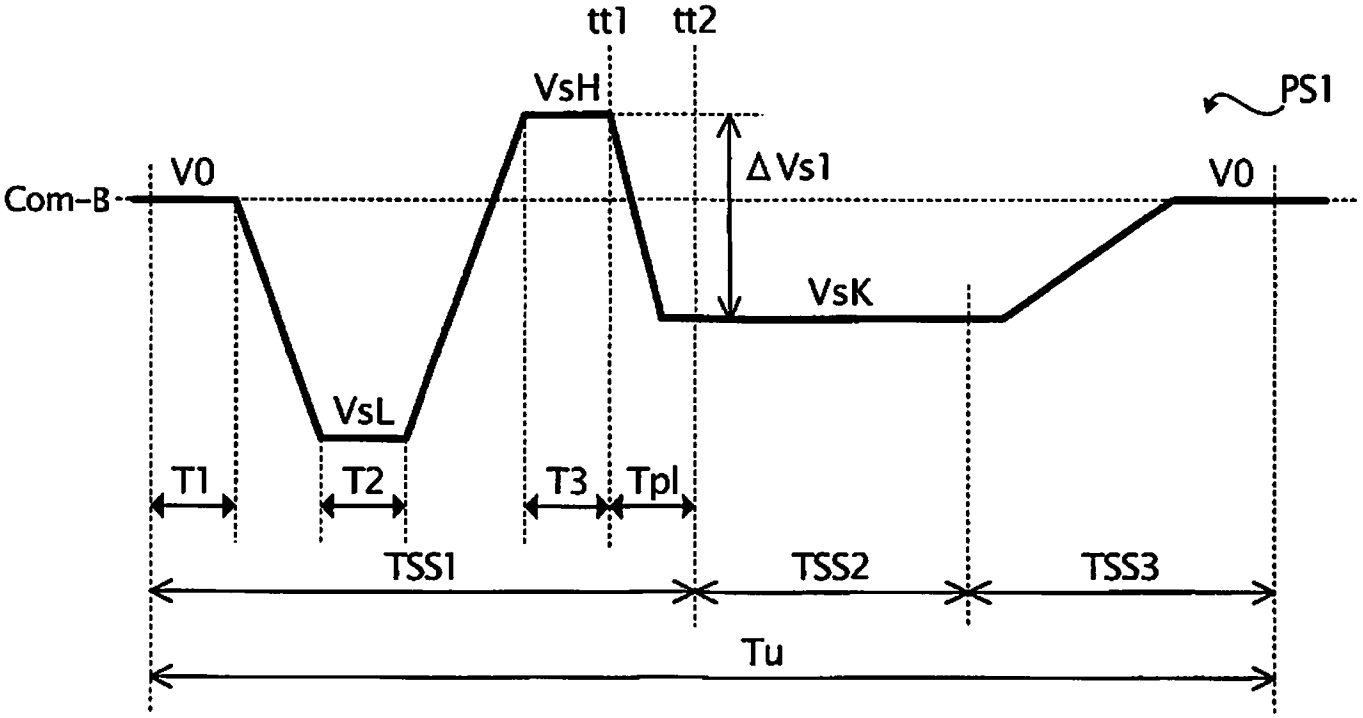
FIG. 7 is a diagram for illustrating an example of a waveform.

FIG. 7 is a timing chart showing a waveform PS1 having the driving signal Com-B. As shown in FIG. 7, the waveform PS1 is a waveform that maintains the reference potential V0 in a period T1 including a start time of the control period TSS1, maintains a potential VsL that is lower than the reference potential V0 in a period T2 starting after the period T1 in the control period TSS1, maintains a potential VsH that is higher than the reference potential V0 in a period T3 starting after the period T2 in the control period TSS1, and maintains a potential Vsk between the reference potential V0 and the potential VsL in the control period TSS2. That is, the waveform PS1 is a waveform that is changed from the reference potential V0 to the potential VsL in a period from a termination time of the period T1 to a starting time of the period T2, is changed from the potential VsL to the potential VsH in a period from a termination time of the period T2 to a starting time of the period T3, is changed from the potential VsH to the potential VsK in a period Tp1 from a time point tt1 at which the period T3 is terminated to a time point tt2 at which the control period TSS2 starts, and is changed from the potential VsK to the reference potential V0 in the control period TSS3. In the present embodiment, when the discharge portion D[m] is driven by the supply driving signal Vin[m] having the waveform PS1, the volume of the cavity 322 of the discharge portion D[m] when the potential of the supply driving signal Vin[m] is the potential VsH is smaller than the volume of the cavity 322 of the discharge portion D[m] when the potential of the supply driving signal Vin[m] is the potential VsK. In other words, in the present embodiment, when the discharge portion D[m] is driven by the supply driving signal Vin[m] having the waveform PS1, the volume of the cavity 322 of the discharge portion D[m] is enlarged in the period Tp1 and the ink in the discharge portion DM is drawn in the +Z direction in the period Tp1. Further, in the present embodiment, when the discharge portion DM is driven by the supply driving signal Vin[m] having the waveform PS1, the waveform PS1 is determined such that the ink is not discharged from the discharge portion D[m]. In the present embodiment, the control period TSS1 is an example of a "driving period", and the control period TSS2 is an example of a "detection period". Further, in the present embodiment, the period T1 is an example of a "first period", the period T2 is an example of a "second period", and the period T3 is an example of a "third period". Further, in the present embodiment, the reference potential V0 is an example of a "first potential", the potential VsL is an example of a "second potential", the potential VsH is an example of a "third potential", and the potential VsK is an example of a "detection potential". Further, in the present embodiment, a potential difference between the potential VsH and the potential VsK is referred to as a potential difference ΔVs1.

FIG. 8 is a table for illustrating relationships between the individual designation signal Sd[m] and the coupling state designating signals Ga[m], Gb[m], and Gs[m]. As shown in FIG. 8, when the individual designation signal Sd[m] indicates the value "1" that designates the driving of the mode in which the amount of the ink, corresponding to the large dot, is discharged to the discharge portion D[m] in the unit period Tu, the coupling state designating circuit 311 sets the coupling state designating signal Ga[m] to the high level during the unit period Tu. In this case, since the switch Ra[m] is switched on during the unit period Tu, the discharge portion D[m] is driven by the supply driving signal Vin[m] having the waveform PX and the waveform PY during the unit period Tu, to discharge the amount of the ink, corresponding to the large dot. As shown in FIG. 8, when the individual designation signal Sd[m] indicates, in the unit period Tu, the value "2" that designates the driving of the mode in which the amount of the ink, corresponding to the middle dot, is discharged to the discharge portion D[m], the coupling state designating circuit 311 sets the coupling state designating signal Ga[m] to the high level only during the control period Tu1. In this case, since the switch Ra[m] is switched on only during the control period Tu1, in the unit period Tu, the discharge portion D[m] is driven by the supply driving signal Vin[m] having the waveform PX, to discharge the amount of the ink, corresponding to the middle dot. As shown in FIG. 8, when the individual designation signal Sd[m] indicates, in the unit period Tu, the value "3" that designates the driving of the mode in which the amount of the ink, corresponding to the small dot, is discharged to the discharge portion D[m], the coupling state designating circuit 311 sets the coupling state designating signal Ga[m] to the high level only during the control period Tu2. In this case, since the switch Ra[m] is switched on only during the control period Tu2, in the unit period Tu, the discharge portion D[m] is driven by the supply driving signal Vin[m] having the waveform PY, to discharge the amount of the ink, corresponding to the small dot. As shown in FIG. 8, when the individual designation signal Sd[m] indicates, in the unit period Tu, the value "4" that designates the driving of the mode in which the ink is not discharged to the discharge portion D[m], the coupling state designating circuit 311 sets the coupling state designating signals Ga[m], Gb[m], and Gs[m] to the low level during the unit period Tu. In this case, the discharge portion D[m] is not driven by the driving signal Com in the unit period Tu, and does not discharge the ink. As shown in FIG. 8, when the individual designation signal Sd[m] indicates, in the unit period Tu, the value "5" that designates the driving as the determination target discharge portion D-S with respect to the discharge portion D[m], the coupling state designating circuit 311 sets the coupling state designating signal Gb[m] to the high level in the control period TSS1 and the control period TSS3, and sets the coupling state designating signal Gs[m] to the high level in the control period TSS2. In this case, the switch Rb[m] is switched on during the control period TSS1 and the control period TSS3, and the switch Rs[m] is switched on during the control period TSS2. That is, in this case, the discharge portion D[m] is driven by the supply driving signal Vin[m] having the waveform PS1 during the control period TSS1, and a state in which the residual vibration occurs in the discharge portion DM is created during the control period TSS2. That is, in this case, in the control period TSS2, the potential of the upper electrode Zu[m] of the discharge portion D[m] changes according to the residual vibration occurring in the discharge portion D[m]. Therefore, in this case, in the control period TSS2, the detection circuit 33 detects a detection potential signal Vout[m] based on the residual vibration occurring in the discharge portion DM.

As described above, the detection circuit 33 generates the residual vibration signal Vd[m] based on the detection potential signal Vout[m]. In detail, the detection circuit 33 amplifies the detection potential signal Vout[m] and removes noise components to generate the residual vibration signal Vd[m] shaped into a waveform suitable for processing in the determination unit JU. That is, in the present embodiment, the residual vibration signal Vd[m] indicates a waveform of the residual vibration occurring in the discharge portion D[m] during the control period TSS2.

5. Determination Unit

Next, the residual vibration occurring in the discharge portion D will be described, and then the determination unit JU will be described.

In general, the residual vibration occurring in the discharge portion D has a natural vibration period that is determined by the shapes and the sizes of the nozzle N and the cavity 322, the weight of the ink filled in the cavity 322, and the like. For example, in general, when the discharge abnormality occurs since air bubbles are mixed in the cavity 322 of the discharge portion D, a period of the residual vibration occurring in the discharge portion D becomes shorter, as compared to a case where the discharge state is normal. Further, in general, when the discharge abnormality occurs since foreign matter such as paper dust adheres to the vicinity of the nozzle N of the discharge portion D, the period of the residual vibration occurring in the discharge portion D becomes longer, as compared to a case where the discharge state is normal. In this way, a period Tc of the residual vibration occurring in the discharge portion D fluctuates according to the discharge state of the ink in the discharge portion D. Therefore, the discharge state of the ink in the discharge portion D can be determined based on the period Tc of the residual vibration occurring in the discharge portion D. As described above, the residual vibration signal Vd[m] indicates a waveform of the residual vibration occurring in the discharge portion D[m] driven as the determination target discharge portion D-S. That is, the residual vibration signal Vd[m] has the period Tc. Therefore, the discharge state of the ink in the discharge portion D[m] can be determined based on the period Tc of the residual vibration signal Vd[m].

As described above, the determination unit JU includes the period specifying circuit 61 and the discharge state determining circuit 62. Among them, the period specifying circuit 61 compares the residual vibration signal Vd[m] with a center level of the amplitude of the residual vibration signal Vd[m]. Then, the period specifying circuit 61 specifies the period Tc of the residual vibration signal Vd[m] and generates the period information NTC showing the period Tc, based on a result of the comparison. Further, the discharge state determining circuit 62 determines a discharge state of the ink in the discharge portion D[m] driven as the determination target discharge portion D-S by comparing the period Tc of the period information NTC with at least one of a threshold Tth1 or a threshold Tth2, and generates the determination information HNT showing a result of the determination. Here, the threshold Tth1 is a value that indicates a boundary between the period Tc of the residual vibration when the discharge state of the determination target discharge portion D-S is normal and the period Tc of the residual vibration when air bubbles are mixed with the cavity 322 of the determination target discharge portion D-S. Further, the threshold Tth2 is a value that is larger than the threshold Tth1, and is a value that indicates a boundary between the period Tc of the residual vibration when the discharge state of the determination target discharge portion D-S is normal and the period Tc of the residual vibration when foreign matter adheres to the vicinity of the nozzle N of the determination target discharge portion D-S. Then, when the period Tc indicating the period information NTC satisfies "Tth1≤Tc≤Tth2", the discharge state determining circuit 62 determines that the discharge state of the ink in the determination target discharge portion D-S is normal. Then, in this case, the discharge state determining circuit 62 sets a value, for example, "1", which indicates that the discharge state of the ink in the determination target discharge portion D-S with respect to the determination information HNT is normal. Further, when the period Tc indicating the period information NTC satisfies "Tc<Tth1", the discharge state determining circuit 62 determines that the discharge abnormality occurs due to air bubbles in the determination target discharge portion D-S. Then, in this case, the discharge state determining circuit 62 sets a value, for example, "2", which indicates that the discharge abnormality occurs due to the air bubbles in the determination target discharge portion D-S with respect to the determination information HNT. Further, when the period Tc indicating the period information NTC satisfies "Tc>Tth2", the discharge state determining circuit 62 determines that the discharge abnormality occurs due to the adhering foreign matter in the determination target discharge portion D-S. Then, in this case, the discharge state determining circuit 62 sets a value, for example, "3", which indicates that the discharge abnormality occurs due to the adhering foreign matter in the determination target discharge portion D-S with respect to the determination information HNT.

6. Effect of Embodiment

Hereinafter, after the period Tc of the residual vibration occurring in the discharge portion D[m] when the foreign matter such as paper dust adheres to the nozzle N of the discharge portion D[m] is described, effects of the present embodiment will be described.

Figure 9:
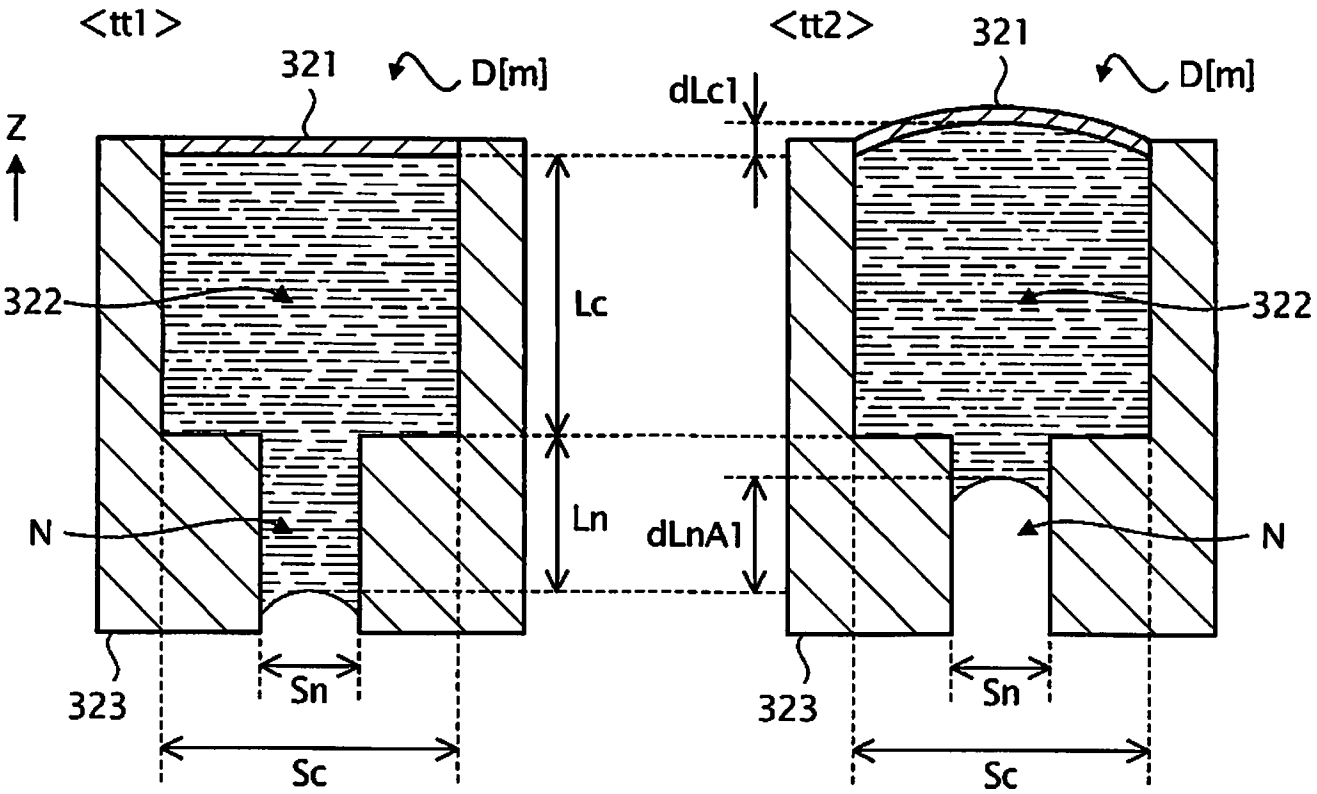
FIG. 9 is a diagram for illustrating an example of movement of ink in a discharge portion.

FIG. 9 is a diagram for illustrating movement of the ink in the discharge portion D[m] when the discharge state of the ink in the discharge portion D[m] is normal. As shown in FIG. 9, when "Lc" denotes the length of the cavity 322 in the Z axis direction, "Sc" denotes a cross section when the cavity 322 is cut in a plane perpendicular to the Z axis direction, and "ρ" denotes the density of the ink inside the discharge portion D[m], an inertance Mc of the ink in the cavity 322 is expressed by Equation (1). Further, when "Ln" denotes the length of the ink existing in the nozzle N in the Z axis direction, and "Sn" denotes a cross section when the nozzle N is cut in a plane perpendicular to the Z axis direction, an inertance Mn of the ink in the nozzle N is expressed by Equation (2).

$$M_c = \frac{\rho \cdot L_c}{S_c} \tag{1}$$

$$M_n = \frac{\rho \cdot L_n}{S_n} \tag{2}$$

In the discharge portion D[m] driven by the supply driving signal Vin[m] having the waveform PS1, when "dLc1" denotes a change in the length Lc in the period Tp1, a change dMc1 in the inertance Mc of the ink in the cavity 322 in the period Tp1 is expressed by Equation (3). Further, in the discharge portion D[m] driven by the supply driving signal Vin[m] having the waveform PS1, when "dLnA1" denotes a change in the length Ln in the period Tp1, a change dMnA1 in the inertance Mn in the nozzle N in the period Tp1 is expressed by Equation (4).

$$dM_c1 = \frac{\rho \cdot dL_c1}{S_c} \tag{3}$$

$$dM_nA1 = \frac{\rho \cdot dL_nA1}{S_n} \tag{4}$$

In general, the period Tc of the residual vibration occurring in the discharge portion DM is expressed by Equation (5) using the inertance Mc expressed by Equation (1), the inertance Mn expressed by Equation (2), and a compliance Cm of the discharge portion D[m]. Then, in the discharge portion D[m] driven by the supply driving signal Vin[m] having the waveform PS1, a period change dTcA1, which is a difference between a period of the vibration occurring at a time tt1 and a period of the vibration occurring at a time tt2, is expressed by Equation (6).

$$T_c = 2\pi\sqrt{(M_c + M_n) \cdot Cm} \tag{5}$$

$$dT_cA1 = 2\pi\sqrt{(dM_c1 + dM_nA1) \cdot Cm} \tag{6}$$

Figure 10:
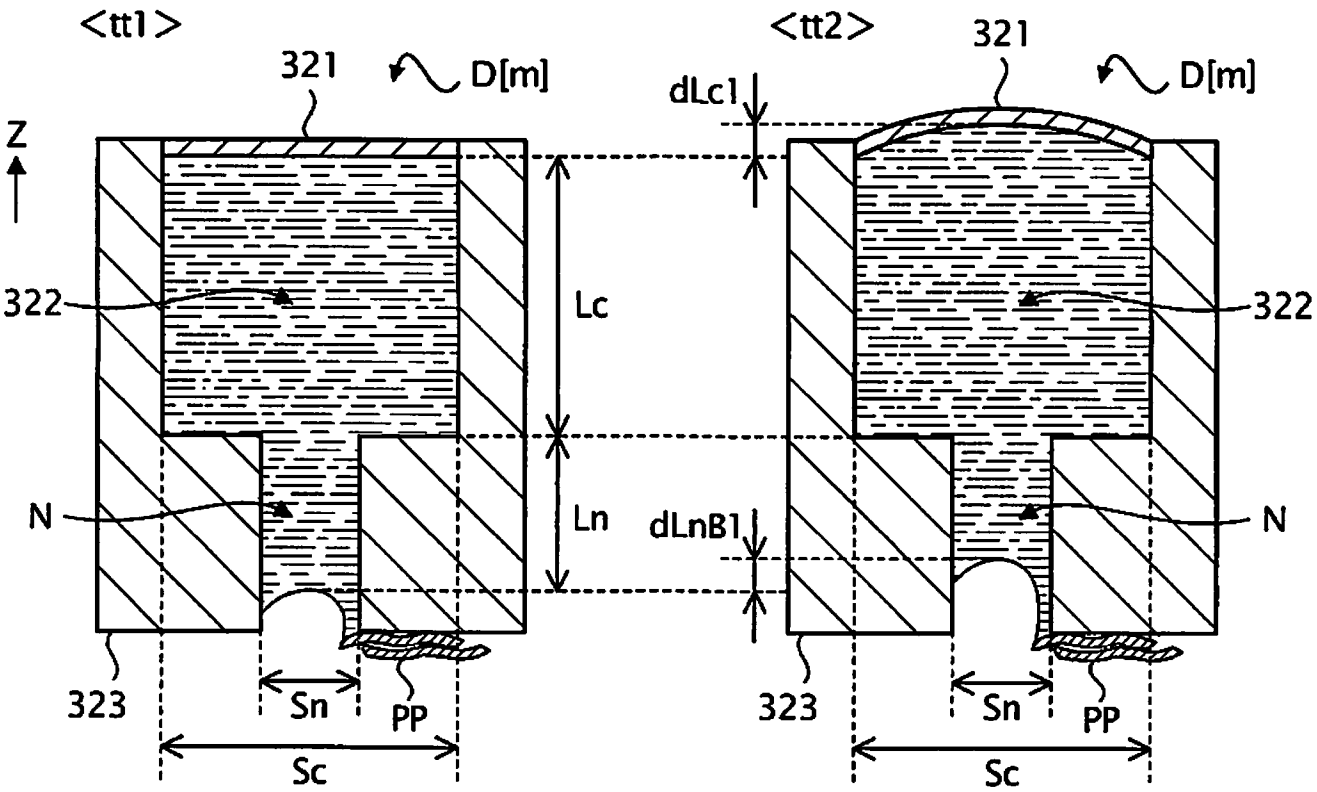
FIG. 10 is a diagram for illustrating an example of movement of ink in the discharge portion.

FIG. 10 is a diagram for illustrating movement of the ink in the discharge portion D[m] when the discharge abnormality occurs since foreign matter PP adheres to the vicinity of the nozzle N of the discharge portion D[m]. As shown in FIG. 10, in a case where the foreign matter PP adheres to the vicinity of the nozzle N of the discharge portion D[m] driven by the supply driving signal Vin[m] having the waveform PS1, when "dLnB1" denotes the change in the length Ln in the period Tp1, a change dMnB1 in the inertance Mn in the ink in the nozzle N in the period Tp1 is expressed by Equation (7). Then, when the foreign matter PP adheres to the vicinity of the nozzle N of the discharge portion D[m] driven by the supply driving signal Vin[m] having the waveform PS1, a period change dTcB1, which is a difference between the period of the vibration occurring at the time tt1 and the period of the vibration occurring at the time tt2, is expressed by Equation (8).

$$dM_nB1 = \rho \cdot dL_nB1/S_n \tag{7}$$

$$dT_cB1 = 2\pi\sqrt{(dM_c1 + dM_nB1) \cdot Cm} \tag{8}$$

In general, the cross section Sn is smaller than the cross section Sc, and the change dLc1 is smaller the change dLnA1. Therefore, in the present embodiment, it is assumed that "dLc1÷Sc" in Equation (3) is negligibly smaller than "dLnA1÷Sn" in Equation (4). In other words, in the present embodiment, it is assumed that the change dMc1 is negligibly smaller than the change dMnA1. Therefore, in the present embodiment, Equation (6) may be approximated to Equation (9). Similarly, since the change dLc1 is smaller than the change dLnB1, in the present embodiment, it is assumed that "dLc1÷Sc" in Equation (3) is negligibly smaller than "dLnB1÷Sn" in Equation (7). In other words, in the present embodiment, it is assumed that the change dMc1 is negligibly smaller than the change dMnB1. Therefore, in the present embodiment, Equation (8) is approximated to Equation (10).

$$dT_cA1 \cong 2\pi\sqrt{dM_nA1 \cdot Cm} \tag{9}$$

$$dT_cB1 \cong 2\pi\sqrt{dM_nB1 \cdot Cm} \tag{10}$$

Here, when a coefficient ω is defined by Equation (11), a differential value dTc1 between the period change dTcA1 and the period change dTcB1 is expressed by Equation (12).

$$\omega = 2\pi\sqrt{\frac{\rho \cdot Cm}{S_n}} \tag{11}$$

$$dT_c1 = dT_cA1 - dT_cB1 \cong \omega \cdot \left(\sqrt{dL_nA1} - \sqrt{dL_nB1}\right) \tag{12}$$

As shown in FIG. 10, when the foreign matter PP adheres to the vicinity of the nozzle N of the discharge portion DM, in the period Tp1, even though it is attempted to draw the ink inside the discharge portion D[m] in the +Z direction, a meniscus surface, which is a boundary between the ink inside the discharge portion D[m] and outdoor air, cannot be greatly drawn in the +Z direction due to an influence of a surface tension of the ink in contact with the foreign matter PP. Therefore, when the foreign matter PP adheres to the vicinity of the nozzle N of the discharge portion D[m] as shown in FIG. 10, the meniscus surface in the period Tp1 is smaller as compared to a case where the foreign matter PP does not adhere to the vicinity of the nozzle N of the discharge portion D[m] as shown in FIG. 9. Thus, the meniscus surface is pressed. In other words, the change dLnB1 shown in FIG. 10 is smaller than the change dLnA1 shown in FIG. 9. Therefore, the period Tc when the foreign matter PP adheres to the vicinity of the nozzle N of the discharge portion D[m] is longer than the period Tc when the foreign matter PP does not adhere to the vicinity of the nozzle N of the discharge portion D[m], by the differential value dTc1 represented in Equation (12). Accordingly, the discharge state determining circuit 62 may determine whether or not the foreign matter PP adheres to the vicinity of the nozzle N of the discharge portion D[m], based on the period Tc of the residual vibration occurring in the discharge portion D[m].

Hereinafter, for convenience of description of the effects of the present embodiment, a reference example, which is an aspect in which the discharge portion D[m] is driven by the supply driving signal Vin[m] having the waveform PS2 instead of driving the discharge portion D[m] by the supply driving signal Vin[m] having the waveform PS1, will be described.

Figure 11:
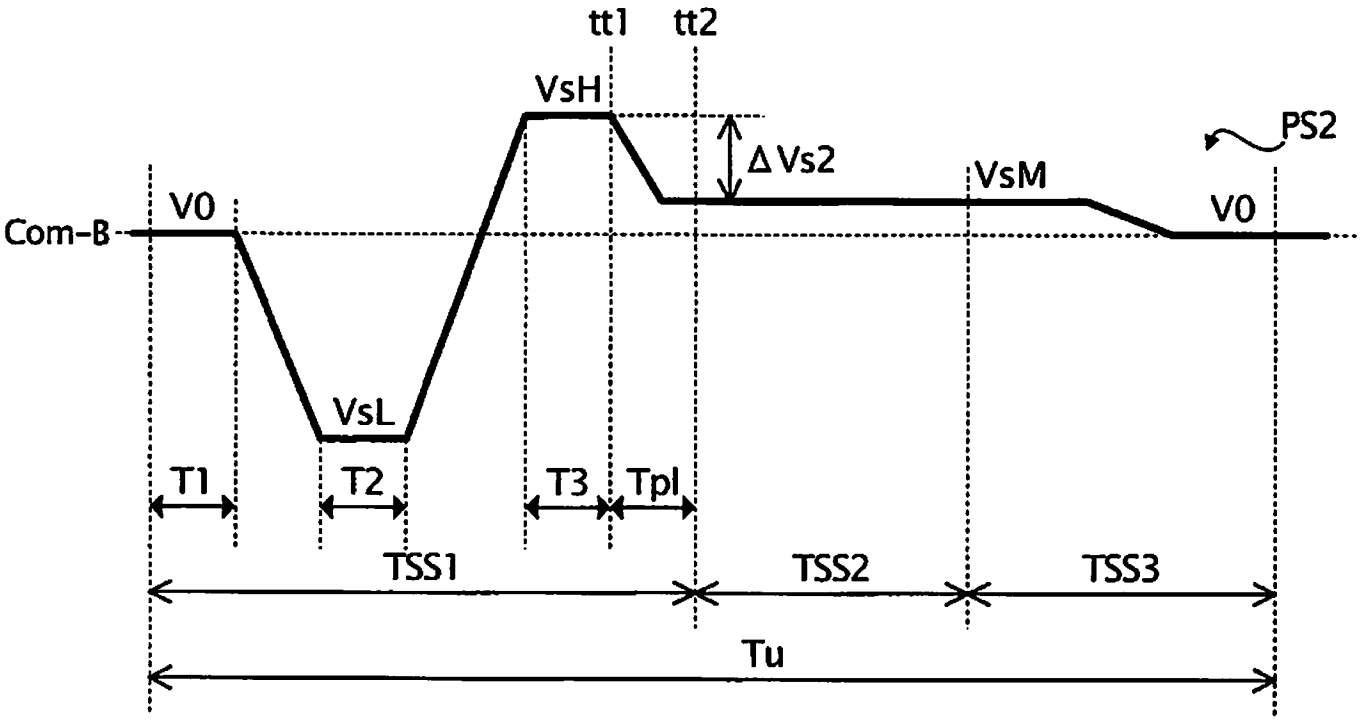
FIG. 11 is a diagram for illustrating an example of a waveform.

FIG. 11 is a timing chart showing the waveform PS2. As shown in FIG. 11, the waveform PS2 is different from the waveform PS1 in that the former is changed from the potential VsH to the potential VsM in the period Tp1, is maintained at the potential VsM in the control period TSS2, and is changed from the potential VsM to the reference potential V0 in the control period TSS3. Here, the potential VsM is a potential between the potential VsH and the reference potential V0. As can be seen in FIGS. 7 and 11, a potential difference ΔVs2 between the potential VsH and the potential VsM is smaller than the potential ΔVs1. Therefore, as in the reference example, when the discharge portion DM is driven by the supply driving signal Vin[m] having the waveform PS2, as in the present embodiment, the amount of the ink inside the discharge portion DM, which is drawn in the +Z direction, is smaller in the period Tp1, as compared to a case where the discharge portion DM is driven by the supply driving signal Vin[m] having the waveform PS1.

In the reference example, when "dLc2" denotes a change in the length Lc in the period Tp1, a change dMc2 in the inertance Mc of the ink inside the cavity 322 in the period Tp1 is expressed by Equation (13). Further, in the reference example, when the discharge state of the ink of the discharge portion DM is normal, if "dLnA2" denotes the change in the length Ln in the period Tp1, a change dMnA2 in the inertance Mn of the ink in the nozzle N in the period Tp1 is expressed by Equation (14). Then, in this case, in the discharge portion D[m], a period change dTcA2, which is a difference between the period of the vibration occurring at the time tt1 and the period of the vibration occurring at the time tt2, is expressed by Equation (15). Further, in the reference example, when the discharge abnormality occurs since the foreign matter PP adheres to the vicinity of the nozzle N of the discharge portion DM, if "dLnB2" denotes the change in the length Ln in the period Tp1, a change dMnB2 in the inertance Mn of the ink in the nozzle N in the period Tp1 is expressed by Equation (16). Then, in this case, in the discharge portion D[m], a period change dTcB2, which is a difference between the period of the vibration occurring at the time tt1 and the period of the vibration occurring at the time tt2, is expressed by Equation (17).

$$dM_c2 = \frac{\rho \cdot dL_c2}{S_c} \tag{13}$$

$$dM_nA2 = \frac{\rho \cdot dL_nA2}{S_n} \tag{14}$$

$$dT_cA2 = 2\pi\sqrt{(dM_c2 + dM_nA2) \cdot Cm} \cong 2\pi\sqrt{dM_nA2 \cdot Cm} \tag{15}$$

$$dM_nB2 = \frac{\rho \cdot dL_nB2}{S_n} \tag{16}$$

$$dT_cB2 = 2\pi\sqrt{(dM_c2 + dM_nB2) \cdot Cm} \cong 2\pi\sqrt{dM_nB2 \cdot Cm} \tag{17}$$

Then, the period change dTcA2 when the foreign matter PP adheres to the vicinity of the nozzle N of the discharge portion D[m] is longer than the period change dTcB2 when the foreign matter PP does not adhere to the vicinity of the nozzle N of the discharge portion D[m], by a differential value dTc2 represented in Equation (18).

$$dT_c2 = dT_cA2 - dT_cB2 \approx \omega \cdot (\sqrt{dL_nA2} - \sqrt{dL_nB2}) \tag{18}$$

Figure 12:
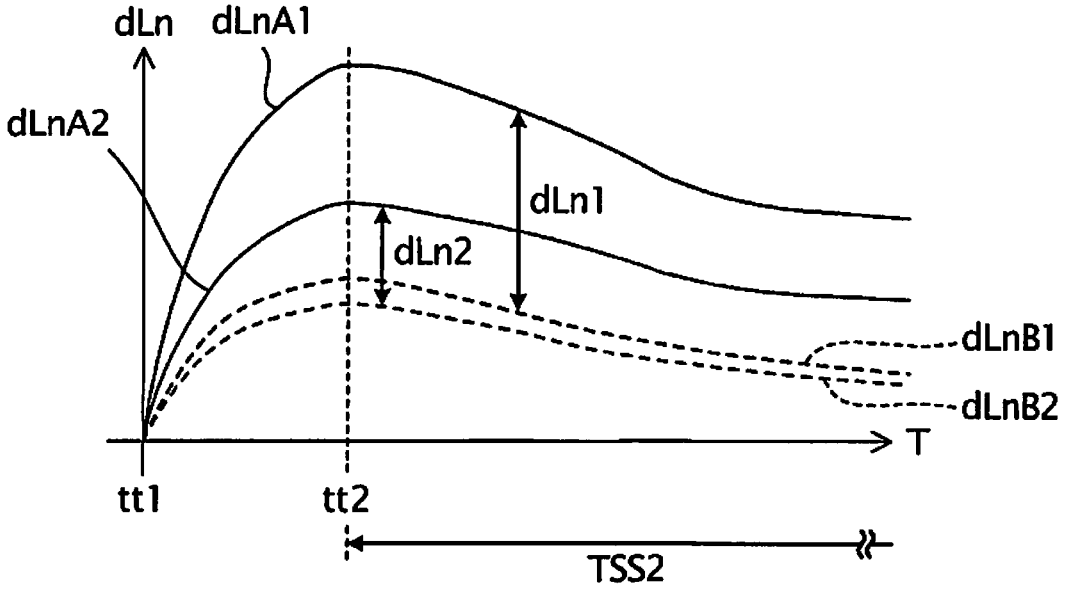
FIG. 12 is a diagram for illustrating an example of movement of a meniscus surface.

FIG. 12 is a diagram for illustrating a relationship between a differential value dLn1 between the change dLnA1 and the change dLnB1 and a differential value dLn2 between the change dLnA2 and the change dLnB2. As described above, the potential difference ΔVs1 in the period Tp1 of the waveform PS1 is larger than the potential difference ΔVs2 in the period Tp1 of the waveform PS2. Therefore, as shown in FIG. 12, in the control period TSS2, the change dLnA1 is larger than the change dLnA2. On the other hand, when the foreign matter PP adheres to the vicinity of the nozzle N of the discharge portion D[m], in the period Tp1, even when the ink in the discharge portion D[m] is greatly drawn in the +Z direction, the fact that the meniscus surface, which is the boundary between the ink in the discharge portion D[m] and the outdoor air, cannot be greatly drawn in the +Z direction is the same both when the discharge portion D[m] is driven by the supply driving signal Vin[m] having the waveform PS2 and when the discharge portion D[m] is driven by the supply driving signal Vin[m] having the waveform PS1. Therefore, as shown in FIG. 12, in the control period TSS2, the change dLnB1 is substantially the same as the change dLnB2. In the present specification, "substantially the same" is a concept including a case where an error of a predetermined ratio exists between two components in addition to a case where two components are completely the same. Here, the error of the predetermined ratio may be, for example, an error of 10%. Therefore, as shown in FIG. 12, the differential value dLn1 between the change dLnA1 and the change dLnB1 is larger than the differential value dLn2 between the change dLnA2 and the change dLnB2. Then, as can be seen from Equation (12) and Equation (18), when the differential value dLn1 is larger than the differential value dLn2, the differential value dTc1 is larger than the differential value dTc2. Therefore, as in the present embodiment, when the discharge portion D[m] is driven by the waveform PS1 that draws the ink in the discharge portion D[m] largely in the +Z direction in the control period TSS2, a difference between the period Tc when the foreign matter PP adheres to the vicinity of the nozzle N of the discharge portion D[m] and the period Tc when the foreign matter PP does not adhere to the vicinity of the nozzle N of the discharge portion D[m] can increase, as compared to the reference example where the discharge portion D[m] is driven by the waveform PS2 that draws the ink in the discharge portion D[m] small in the +Z direction in the control period TSS2. Accordingly, according to the present embodiment, in comparison with the reference example, when the determination unit JU determines whether or not the foreign matter PP adheres to the vicinity of the nozzle N of the discharge portion D[m], accuracy of the determination can increase.

Further, in the present embodiment, the ink in the discharge portion D[m] is drawn in the +Z direction from the termination time of the period T1 to the starting time of the period T2, the ink in the discharge portion D[m] is pushed out in the −Z direction from the termination time of the period T2 to the starting time of the period T3, and the ink in the discharge portion is then drawn in the +Z direction in the period Tp1 again. That is, according to the present embodiment, as the ink in the discharge portion D[m] is drawn in the +Z direction from the termination time of the period T1 to the starting time of the period T2, the ink in the discharge portion D[m] can be pushed out in the −Z direction from the termination time of the period T2 to the starting time of the period T3, as compared to a case where the ink in the discharge portion D[m] is not drawn. Further, according to the present embodiment, as the ink in the discharge portion D[m] is pushed out in the −Z direction from the termination time of the period T2 to the starting time of the period T3, the ink in the discharge portion D[m] can be strongly drawn in the +Z direction in the period Tp1, as compared to a case the ink in the discharge portion D[m] is not pushed out. That is, according to the present embodiment, as compared to a case where the ink in the discharge portion D[m] is not drawn in the +Z direction from the termination time of the period T1 to the starting time of the period T2 or a case where the ink in the discharge portion DM is not pushed out in the −Z direction from the termination time of the period T2 to the starting time of the period T3, the ink in the discharge portion D[m] can be strongly drawn in the +Z direction in the period Tp1. Therefore, according to the present embodiment, as compared to a case where the ink in the discharge portion D[m] is not drawn in the +Z direction from the termination time of the period T1 to the starting time of the period T2 or a case where the ink in the discharge portion DM is not pushed out in the −Z direction from the termination time of the period T2 and the starting time of the period T3, a difference between the period Tc when the foreign matter PP adheres to the vicinity of the nozzle N of the discharge portion DM and the period Tc when the foreign matter PP does not adhere to the vicinity of the nozzle N of the discharge portion D[m] can increase. Further, when the determination unit JU determines whether or not the foreign matter PP adheres to the vicinity of the nozzle N of the discharge portion DM, the accuracy of the determination can increase.

B. Second Embodiment

Here, a second embodiment of the present disclosure will be described. In each aspect described below, an element having an effect and a function that are the same as those of the first embodiment is designated by a reference numeral used in the first embodiment, and detailed description thereof will be described.

The second embodiment is different from the first embodiment in which the determination target discharge portion D-S is driven by the waveform PS1, in that the determination target discharge portion D-S is driven by the waveform PS3.

Figure 13:
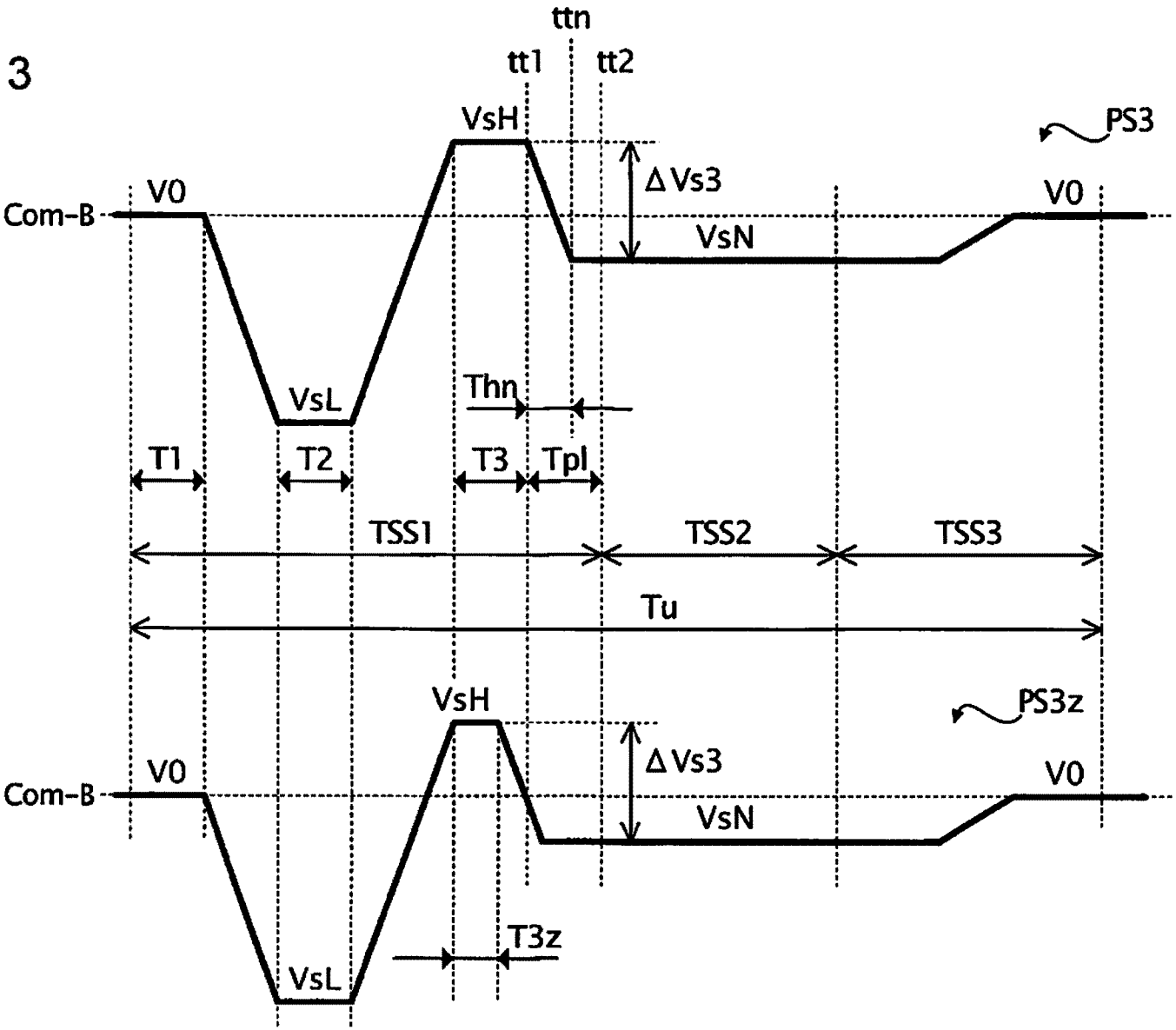
FIG. 13 is a diagram for illustrating an example of a waveform according to a second embodiment of the present disclosure.

FIG. 13 is a timing chart showing the waveform PS3. As shown in FIG. 13, the waveform PS3 is different from the waveform PS1 in that the former is changed from the potential VsH to the potential VsN in the period Tp1, is maintained at the potential VsN in the control period TSS2, and is changed from the potential VsN to the reference potential V0 in the control period TSS3. In the present embodiment, it is assumed that the potential VsN is a potential between the reference voltage V0 and the potential VsL. However, the potential VsN should be the same as the reference potential V0. That is, the waveform PS3 may be determined such that a potential difference ΔVs3 between the potential VsH and the potential VsN is equal to or more than a potential difference between the potential VsH and the reference potential V0 and is equal to or less than a potential difference between the potential VsH and the potential VsL. Here, in the period Tp1, a time when the waveform PS3 firstly reaches the potential VsN is referred to as a time ttn, and a period from the time tt1 to the time ttn is referred to as a period Thn. Further, when the discharge portion D[m] is driven by the waveform PS3, the period Tc of the residual vibration occurring at the discharge portion D[m] in the control period TSS2 is referred to as a period Tc-PS3. Then, when a time length of the period T3 is expressed as "ΔT3", and a time length of the period Thn is expressed as "ΔThn", the waveform PS3 is determined as a waveform satisfying Equation (19).

$$\Delta T3+\Delta Thn<Tc-PS3 \tag{19}$$

When the waveform PS3 satisfies Equation (19), the ink in the discharge portion D[m] can be strongly drawn in the +Z direction in the period Tp1, as compared to a case where the waveform PS3 does not satisfy Equation (19). Therefore, according to the present embodiment, as compared to a case where Equation (19) is not satisfied, the difference between the period Tc when the foreign matter PP adheres to the vicinity of the nozzle N of the discharge portion D[m] and the period Tc when the foreign matter PP does not adhere to the vicinity of the nozzle N of the discharge portion D[m] can increase. When the determination unit JU determines whether or not the foreign matter PP adheres to the vicinity of the nozzle N of the discharge portion D[m], the accuracy of the determination can increase.

In the present embodiment, the waveform PS3 may be determined such that the time length ΔT3 of the period T3 is longer than a time length ΔT3*z* of a period T3*z* during which a waveform PS3*z* shown in FIG. 13 reaches the potential VsH. Here, the waveform PS3*z* is a waveform in which when the discharge portion D[m] is driven by the waveform PS3*z*, the amplitude of the residual vibration occurring in the discharge portion D[m] in the control period TSS2 is minimized, among waveforms obtained by changing the time length of the period T3 of the waveform PS3. In this way, as the time length ΔT3 is longer than the time length ΔT3*z*, the ink in the discharge portion D[m] can be strongly drawn in the +Z direction in the period Tp1, as compared to a case where the time length ΔT3 is equal to the time length ΔT3*z*. Therefore, as the time length ΔT3 is longer than the time length ΔT3*z*, when the determination unit JU determines whether or not the foreign matter PP adheres to the vicinity of the nozzle N of the discharge portion D[m], the accuracy of the determination can increase, as compared to a case where the time length ΔT3 is equal to the time length ΔT3*z*.

C. Modification Example

The above embodiments may be variously modified. Detailed aspects of modification examples will be described below. Two or more aspects selected from the following description in a predetermined manner may be appropriately combined with each other within a range in which the aspects are not contradictory to each other. In the following modification example, an element having an effect or a function that is the same as that of the embodiment is designated by the above-described reference numeral, and detailed description thereof will be omitted.

Modification Example 1

In the above-described embodiments 1 and 2, when the potential of the supply driving signal Vin[m] is a high potential, the volume of the discharge portion D[m] driven by the supply driving signal Vin[m] is reduced. However, the present disclosure is not limited to such an aspect. For example, when the potential of the supply driving signal Vin[m] is a high potential, the piezoelectric element PZ[m] may be provided such that the volume of the discharge portion D[m] driven by the supply driving signal Vin[m] is increased. For example, in the present modification example, the waveform PS1 is a waveform that draws the ink in the discharge portion D[m] in the +Z direction in the period Tp1 as the potential VsK becomes higher than the potential VsH, and is a waveform in which the reference potential V0 is a potential between the potential VsL and the potential VsH, and the potential VsK is a potential between the reference voltage V0 and the potential VsL. Further, in the present modification example, the waveform PS3 is a waveform that draws the ink in the discharge portion DM in the +Z direction in the period Tp1 as the potential VsN becomes higher than the potential VsH, and is a waveform in which the reference potential V0 is a potential between the potential VsL and the potential VsH, and the potential VsN becomes a potential between the reference potential V0 and the potential VsL or the same potential as the reference potential V0.

Modification Example 2

In the above-described embodiments 1 and 2 and the modification example 1, the determination unit JU is provided as a circuit that is separate from the control unit 2. However, the present disclosure is not limited to such an aspect. A part or the entirety of the determination unit JU may be implemented as a functional block realized as the CPU or the like of the control unit 2 is operated according to a control program.

Modification Example 3

In the above-described embodiments 1 and 2 and the modification examples 1 and 2, the ink jet printer 1 is provided such that the four head units HU correspond to the four ink cartridges 310, respectively. However, the present disclosure is not limited to such an aspect. The ink jet printer 1 may include one or more head units HU and one or more ink cartridges 310. Further, in the above-described embodiments 1 and 2 and the modification examples 1 and 2, the determination unit JU corresponding to each head unit HU is provided in the ink jet printer 1. However, the present disclosure is not limited to such an aspect. In the ink jet printer 1, one determination unit JU may be provided for a plurality of head units HU and a plurality of determination units JU may be provided for one head unit HU.

Modification Example 4

In the above-described embodiments 1 and 2 and the modification examples 1 to 3, a case where the ink jet printer 1 is a serial printer is illustrated. However, the present disclosure is not limited to such an aspect. The ink jet printer 1 may be a so-called line printer in which the plurality of nozzles N are provided in the head module 3 to extend wider than the width of the recording paper sheet P.

What is claimed is:

1. A liquid ejecting apparatus comprising:

a generation unit that generates a driving signal;

a discharge portion including a piezoelectric element that is driven by the driving signal and a pressure chamber that discharges a liquid from a nozzle according to the driving of the piezoelectric element; and a detection unit that detects residual vibration occurring in the discharge portion, in a detection period after a driving period during which the piezoelectric element is driven by the driving signal, wherein the generation unit maintains a potential of the driving signal at a first potential in a first period of the driving period, maintains the potential of the driving signal at a second potential in a second period after the first period of the driving period, maintains the potential of the driving signal at a third potential in a third period after the second period of the driving period, and maintains the potential of the driving signal at a detection potential in the detection period, the first potential is a potential between the second potential and the third potential, and the detection potential is a potential between the first potential and the second potential.

2. The liquid ejecting apparatus according to claim 1, wherein a volume of the pressure chamber measured when the potential of the driving signal is the third potential is smaller than a volume of the pressure chamber measured when the potential of the driving signal is the detection potential.

3. The liquid ejecting apparatus according to claim 1, further comprising:

a determination unit that determines whether or not foreign matter adheres to the discharge portion, based on a result of the detection by the detection unit.

4. The liquid ejecting apparatus according to claim 1, wherein the generation unit causes the potential of the driving signal to be changed from the first potential to the second potential in a period from a termination time of the first period to a starting time of the second period, to be changed from the second potential to the third potential in a period from a termination time of the second period to a starting time of the third period, and to be changed from the third potential to the detection potential in a period from a termination time of the third period to a starting time of the detection period.

5. The liquid ejecting apparatus according to claim 1, wherein a time length from the starting time of the third period to the starting time of the detection period is shorter than a period of the residual vibration.

* * * * *